US006808594B2

(12) United States Patent
Supron et al.

(10) Patent No.: US 6,808,594 B2
(45) Date of Patent: Oct. 26, 2004

(54) SYSTEM AND METHOD FOR MANAGING OVERFLOW OF MOISTENING FLUID IN A MAILING MACHINE

(75) Inventors: Steven A. Supron, Middlebury, CT (US); Neil F. Baldino, Sandy Hook, CT (US); Robert P. Rebres, Southbury, CT (US); Norman R. Lilly, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/383,484

(22) Filed: Mar. 7, 2003

(65) Prior Publication Data

US 2004/0173320 A1 Sep. 9, 2004

(51) Int. Cl.[7] ..... B43M 5/00; B43M 11/00

(52) U.S. Cl. ..... 156/441.5; 156/442.2; 156/578; 118/268

(58) Field of Search ..... 156/441.5, 442, 156/442.1, 442.2, 442.3, 442.4, 578; 118/253, 268

(56) References Cited

U.S. PATENT DOCUMENTS 4,995,934 A * 2/1991 Janatka ..... 156/441.5
5,006,194 A * 4/1991 Schmaling ..... 156/442.1
5,156,048 A * 10/1992 DeFigueiredo et al. ..... 73/308
5,354,407 A * 10/1994 Hubbard et al. ..... 156/442.1
5,385,627 A * 1/1995 Weimer ..... 156/441.5
5,569,327 A 10/1996 Paradis et al.
5,665,198 A 9/1997 Bieber et al.
5,674,348 A 10/1997 DeFiguerido
5,746,881 A 5/1998 Jenkins et al.
5,767,167 A * 6/1998 Ferry ..... 521/64
5,807,463 A * 9/1998 Boughton ..... 156/441.5
5,840,123 A 11/1998 Holbrook
6,361,603 B1 3/2002 Salomon
6,708,467 B2 * 3/2004 Antonelli et al. ..... 156/441.5

* cited by examiner

*Primary Examiner*—Sue A. Purvis
(74) *Attorney, Agent, or Firm*—Brian A. Lemm; Angelo N. Chaclas

(57) ABSTRACT

A system and method for managing overflow of moistening fluid in a mailing machine is provided. An overflow pipe is provided in the reservoir, positioned over a sump located beneath the reservoir. The top of the overflow pipe in the reservoir is located slightly above the moistening fluid normal operating level in the reservoir. In the event the level of the moistening fluid rises above the normal operating level to a point above the top of the overflow pipe, the moistening fluid will flow through the overflow pipe and into the sump. The sump contains an absorbent material to absorb any moistening fluid that flows into the sump, thereby preventing the moistening fluid from sloshing out of the sump if the mailing machine is moved. The moistening fluid absorbed by the absorbent material will eventually evaporate, thereby preventing any leakage of the moistening fluid from the mailing machine.

24 Claims, 4 Drawing Sheets

SYSTEM AND METHOD FOR MANAGING OVERFLOW OF MOISTENING FLUID IN A MAILING MACHINE

FIELD OF THE INVENTION

The invention disclosed herein relates generally to mailing systems, and more particularly to a system and method for managing overflow of moistening fluid in a mailing machine.

BACKGROUND OF THE INVENTION

Mailing systems, such as, for example, a mailing machine, often include different modules that automate the processes of producing mail pieces. The typical mailing machine includes a variety of different modules or subsystems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a stripping/moistening module, i.e., stripping open the flap of an envelope, wetting and sealing the glued flap of an envelope, a weighing module, and a metering/printing module, i.e., applying evidence of postage to the mail piece. The exact configuration of the mailing machine is, of course, particular to the needs of the user.

Typically, a stripping/moistening module includes a structure for deflecting a flap of a moving envelope away from the envelope's body to enable the moistening and sealing process to occur. The deflecting structure typically includes a stripper blade that becomes inserted between the flap of the envelope and the body of the envelope as the envelope traverses the transport deck of the mailing machine. Once the flap has been stripped, the moistening device moistens the glue line on the envelope flap in preparation for sealing the envelope. Moistening systems generally fall into two categories: contact and non-contact moistening systems. Non-contact moistening systems generally spray moisture onto the envelope flap with a nozzle and mechanical pump system. The mechanical pump is supplied with moistening fluid from a reservoir and sprays the fluid through the nozzles and onto the envelope flap. The flap is then closed and sealed, such as, for example, by passing the closed envelope through a nip of a sealer roller to compress the envelope and flap together, and the envelope passed to the next module for continued processing.

A contact moistening system generally deposits a moistening fluid, such as, for example, water or water with a biocide, onto the glue line on a flap of an envelope by contacting the glue line with a wetted applicator. In contact systems, the wetted applicator typically consists of a contact media such as a brush, foam or felt. The applicator is in physical contact with a wick. The wick is generally a woven material, such as, for example, felt, or can also be a foam material. At least a portion of the wick is wetted with the moistening fluid from a reservoir. The moistening fluid is transferred from the wick to the applicator by physical contact pressure between the wick and applicator, thereby wetting the applicator. A stripped envelope flap is guided between the wick and applicator, such that the applicator contacts the glue line on the flap of the envelope, thereby transferring the moistening fluid to the flap to activate the glue. The flap is then closed and sealed, such as, for example, by passing the closed envelope through a nip of a sealer roller to compress the envelope and flap together, and the envelope passed to the next module for continued processing.

Regardless of the type of system used, as noted above it is necessary to have a reservoir that holds the moistening fluid to be used by the mailing machine. As the moistening fluid is used during processing of mail pieces, it is necessary to replace the fluid in the reservoir. This is generally performed utilizing a user replaceable bottle that is inserted into the reservoir and empties into the reservoir as the level of moistening fluid in the reservoir decreases. When the bottle has emptied, it is replaced with a new bottle-containing a new supply of moistening fluid.

There are problems, however, with conventional moistening systems in which a reservoir is utilized. In many applications, the moistening fluid from the reservoir is supplied to the moistening device (either contact, i.e., wick/applicator, or non-contact, i.e., mechanical pump) via a gravity pump. As such, it is not possible to completely seal the reservoir, as this could cause changes in pressure within the reservoir and disrupt the operation of the gravity pump. Typically, the top of the reservoir is open to prevent the build-up of any back-pressure and allow the replaceable bottle to be inserted therein. To prevent the moistening fluid in the reservoir from overflowing, it is generally desirable to limit the amount of moistening fluid in the reservoir during normal operation. There are circumstances, however, that can result in the level of the moistening fluid within the reservoir exceeding the normal operating level. For example, repeated raising and lowering of the replacement bottle, such as, for example, to determine if there is moistening fluid still present in the bottle, can cause the moistening fluid within the reservoir to attain a higher than intended level. Additionally, improper sealing of the replacement bottle or failure of the valve device on the replacement bottle can each cause the moistening fluid level within the reservoir to exceed the normal operating level. Since it is not possible to seal the reservoir completely, there is a risk of moistening fluid escaping from the reservoir and causing damage to surrounding components, especially electrical components, or leaking onto the surface supporting the mailing machine, i.e., the customer's tabletop. Additionally, even if the reservoir has not overflowed or exceeded the intended level, the problem still exists as to moving the mailing machine without the moistening fluid sloshing over the sides of the reservoir and leaking out of the mailing machine.

Typically, in any circumstance where there is leakage of the moistening fluid from the mailing machine and onto the customer's tabletop, the customer interprets it as a potential operational or safety problem and initiates a service call. If the leakage was due to a defective or improperly sealed replacement bottle or movement of the machine, the service call is unnecessary and the customer incurs additional unnecessary expenses as well as down time of the mailing machine.

Thus, there exists a need for a system and method for managing overflow of moistening fluid in a mailing machine.

SUMMARY OF THE INVENTION

The present invention alleviates the problems associated with the prior art and provides a system and method for managing overflow of moistening fluid in a mailing machine.

In accordance with the present invention, an overflow pipe is provided in the reservoir. The overflow pipe is positioned over a sump located beneath the reservoir. The top of the overflow pipe in the reservoir is located slightly above the moistening fluid normal operating level in the reservoir. Under normal operating conditions, i.e., the moistening fluid remains at or below the normal operating level within the reservoir, the overflow pipe has no impact on the moistening system. In the event the level of the moistening fluid rises above the normal level to a point above the top of the overflow pipe, the moistening fluid will flow through the overflow pipe and into the sump. The sump contains an absorbent material to absorb any moistening fluid that flows into the sump, thereby preventing the moistening fluid from sloshing out of the sump if the mailing machine is moved. The moistening fluid absorbed by the absorbent material will eventually evaporate, and the overflow of the moistening fluid will have been completely contained within the mailing machine without any type of operator assistance or possibly even knowledge of an overflow. Thus, in the event the moistening fluid level rises above the normal operating level within the reservoir, the moistening fluid will drain into the sump before the reservoir overflows and moistening fluid escapes from the reservoir onto any surrounding components or the supporting surface of the mailing machine.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
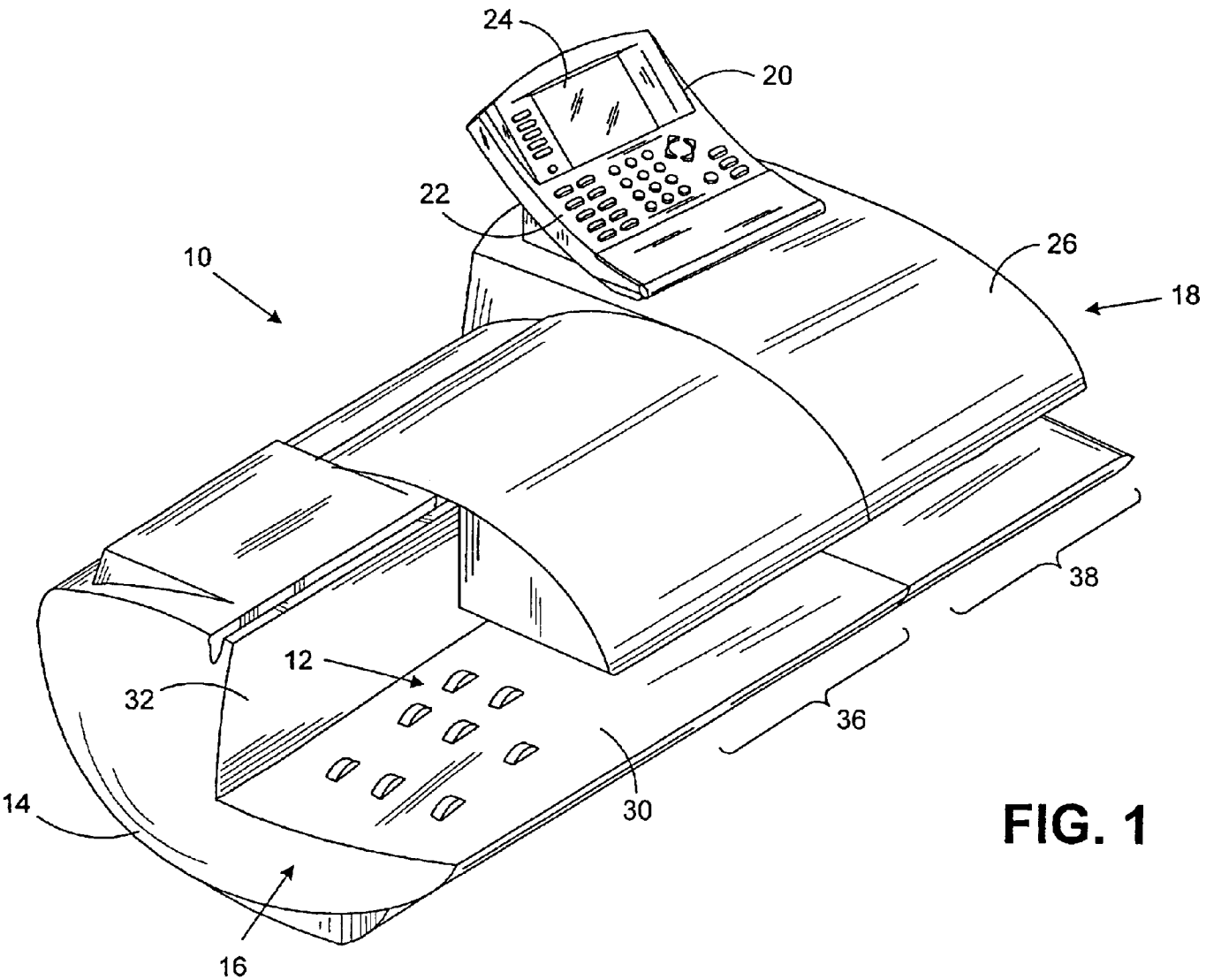
FIG. 1 illustrates a mailing machine having a system and method for managing overflow of moistening fluid according to the present invention.

In describing the present invention, reference is made to the drawings, wherein there is seen in FIG. 1 a mailing machine 10 that includes a system and method for managing overflow of moistening fluid according to the present invention. Mailing machine 10 comprises a base unit, designated generally by the reference numeral 14, the base unit 14 having a mail piece input end, designated generally by the reference numeral 16, and a mail piece output end, designated generally by the reference numeral 18. A control unit 20 is mounted on the base unit 14, and includes one or more input/output devices, such as, for example, a keyboard 22 and a display device 24. One or more cover members 26 are pivotally mounted on the base 14 so as to move from the closed position shown in FIG. 1 to an open position (not shown) to expose various operating components and parts for service and/or repair as needed.

The base unit 14 further includes a horizontal feed deck 30 which extends substantially from the input end 16 to the output end 18. A plurality of nudger rollers 12 are suitably mounted under the feed deck 30 and project upwardly through openings in the feed deck so that the periphery of the rollers 12 is slightly above the upper surface of the feed deck 30 and can exert a forward feeding force on a succession of mail pieces placed in the input end 16. A registration wall 32 defines a mail piece registration surface substantially perpendicular to the feed deck 30 that extends substantially from the input end 16 to the output end 18. Mail pieces placed in the input end 16 are fed by the nudger rollers 12 along the feed deck 30, with the top edge of the mail piece being registered against the wall 32. The mail pieces may be passed through one or more modules, such as, for example, a singulator module and a moistening module that includes an overflow management system according to the present invention as described below. Each of these modules is located generally in the area indicated by reference numeral 36. The mail pieces are then passed to a metering/printing module located generally in the area indicated by reference numeral 38.

Figure 2:
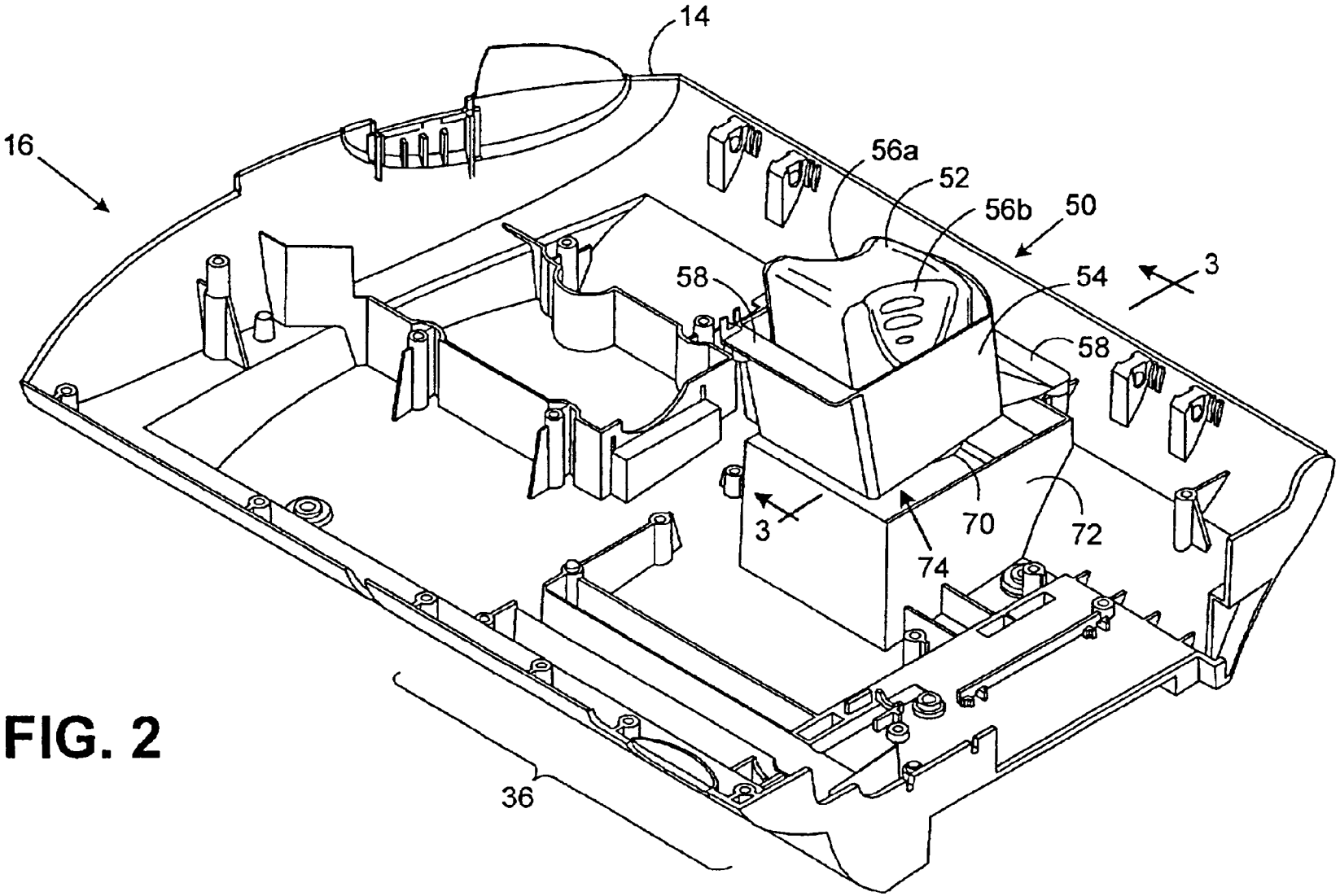
FIG. 2 illustrates an internal view of a portion of the mailing machine illustrated in FIG. 1 showing the moistening fluid overflow management system according to the present invention.

Referring now to FIG. 2, there is illustrated an internal view of a portion of the mailing machine 10 illustrated in FIG. 1 showing a moistening fluid overflow management system 50 according to the present invention. System 50 includes a replaceable bottle 52 that can be inserted into a reservoir 54. Reservoir 54 is preferably mounted to the base unit 14 and internal support structures (not shown) of the mailing machine 10 by, for example, one or more mounting brackets 58. Bottle 52 can be provided with gripping areas 56*a*, 56*b* to allow an operator to grasp the bottle 52 for easy removal and insertion into the reservoir 54. Under normal operation, moistening fluid contained in the bottle 52 empties into the reservoir 54 such that the level of moistening fluid in the reservoir 54 maintains a predetermined desired level as further described below. The reservoir 54 supplies the moistening fluid to a moistening system (not shown) utilizing tubing (not shown) via a gravity pump. The moistening system can be, for example, either a contact or non-contact moistening system.

In accordance with the present invention, reservoir 54 is provided with an overflow pipe 70 that extends through the bottom of the reservoir 54. The overflow pipe 70 empties into a sump 72, preferably provided beneath the overflow pipe 70 such that the bottom of the overflow pipe 70 is located over an open portion 74 of the sump 72. Sump 72 may be integrally formed with the base 14 of the mailing machine 10, or may be secured to the base 14 of mailing machine 10. Preferably, sump 72 is large enough such that it can hold the entire volume of the moistening fluid from bottle 52.

Figure 3:
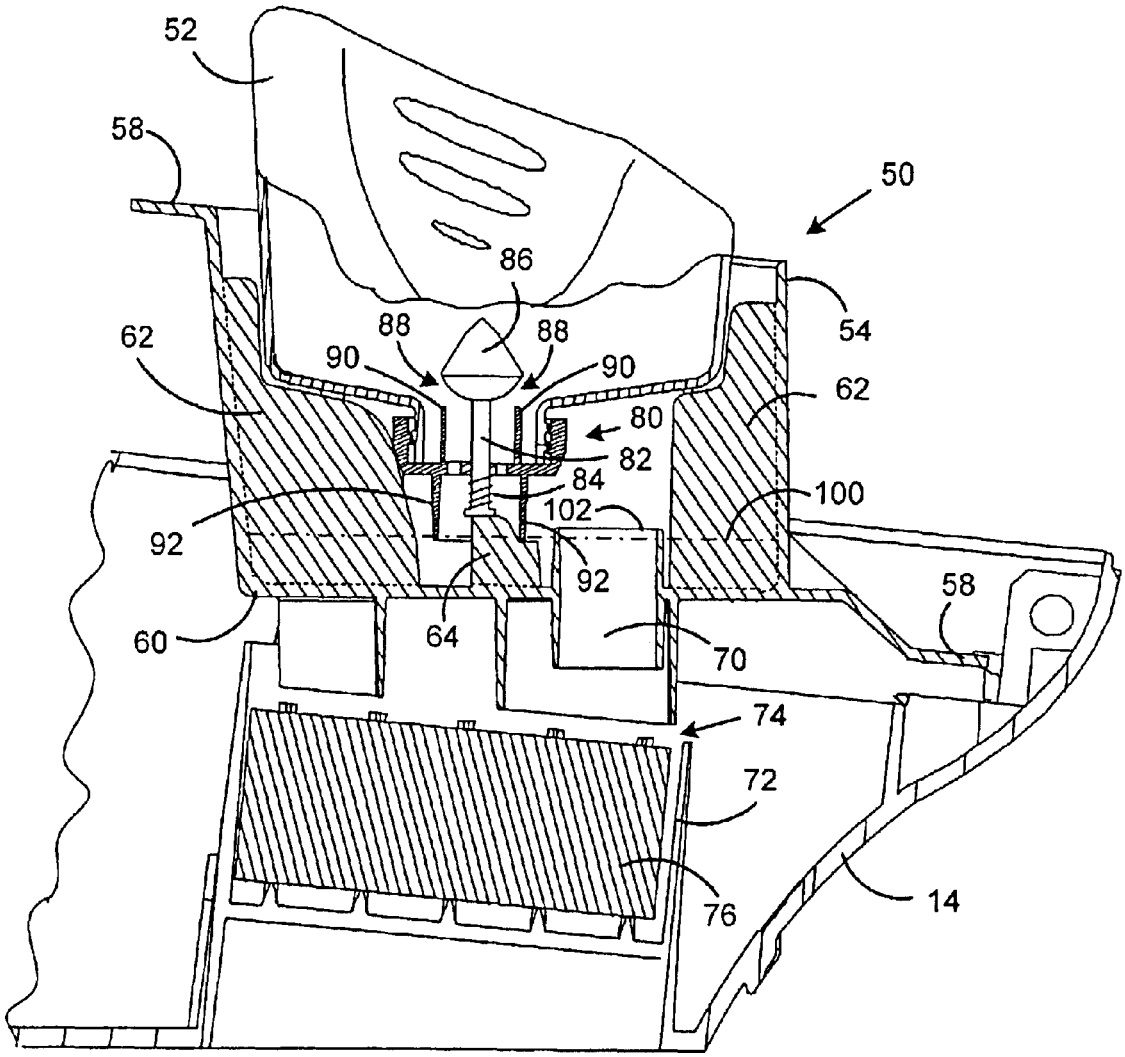
FIG. 3 illustrates a cross-sectional view of the moistening fluid overflow management system according to the present invention.

Referring now to FIG. 3, there is illustrated generally a cross-sectional view of the overflow management system 50 taken along line 3–3' of FIG. 2. The bottle 52 is inserted into the reservoir 54, and may be supported by one or more ribs 62 within the reservoir 54. A valve device 80 allows the moistening fluid within the bottle 52 to discharge in a controlled manner into the reservoir 54. Specifically, when the bottle 52 is inserted into the reservoir 54, a rib 64 contacts a piston 82 of the valve 80. As the bottle 52 is further inserted into the reservoir 54, a spring 84 around the piston 82 is compressed and the piston 82 is pushed up into the bottle 52. As the piston 82 is pushed into the bottle 52, a plunger 86 is raised from a sealed position, in which the plunger 86 seals the bottle 52, to an open position in which gaps 88 are created between the plunger 86 and an internal neck portion 90 of the valve 80. The gaps 88 allow air to enter the bottle 52, which allows the moistening fluid in the bottle 52 to flow out of the gaps 88, through the internal neck portion 90 and an external neck portion 92, and into the reservoir 54. When the level of moistening fluid in the reservoir 54 reaches the normal operating level, illustrated by line 100, the moistening fluid will have reached the height of the external neck portion 92 of the valve 80, thereby effectively sealing the external neck portion 92 and preventing any additional air from entering the bottle 52. This stops the release of any additional moistening fluid from the bottle 52 into the reservoir 54, thereby keeping the level of moistening fluid within the reservoir 54 at approximately the normal operating level 100. As moistening fluid is used through normal operation of the moistening system (not shown) coupled to the reservoir 54, the level of moistening fluid will decrease until it drops below the external neck portion 92 of the bottle 52, thereby allowing air to once again enter the bottle 52. As the air again enters the bottle 52, moistening fluid will again be released from the bottle 52 into the reservoir 54 until it reaches the intended normal operating level 100. When the bottle 52 is removed from the reservoir 54, the spring 84 will decompress, thereby pulling the piston 82 from the bottle 52 and moving the plunger 86 back to the sealed position. It should be understood, of course, that any type of valve device can be utilized and the present invention is not limited to valve device 80 as described above.

Figure 4:
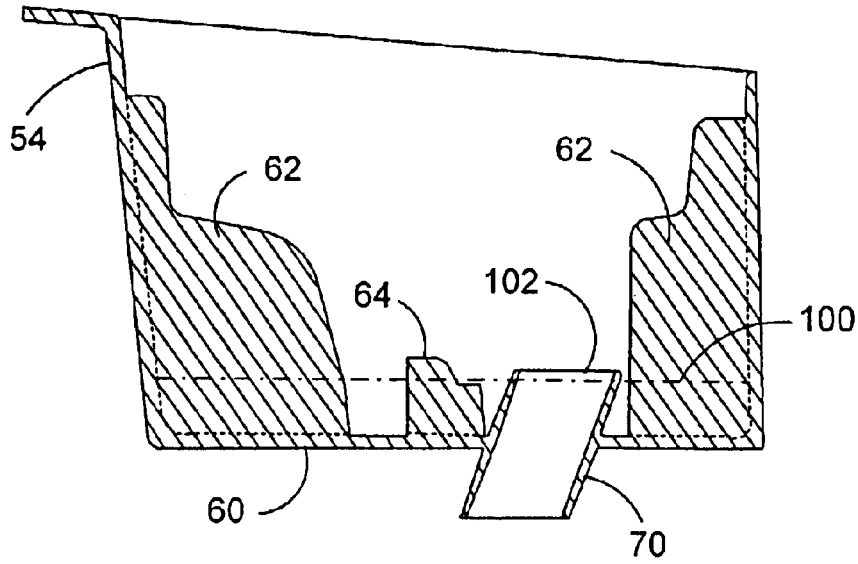
FIG. 4 illustrates a cross-sectional view of a reservoir having an overflow pipe according to another embodiment of the present invention.
Figure 5:
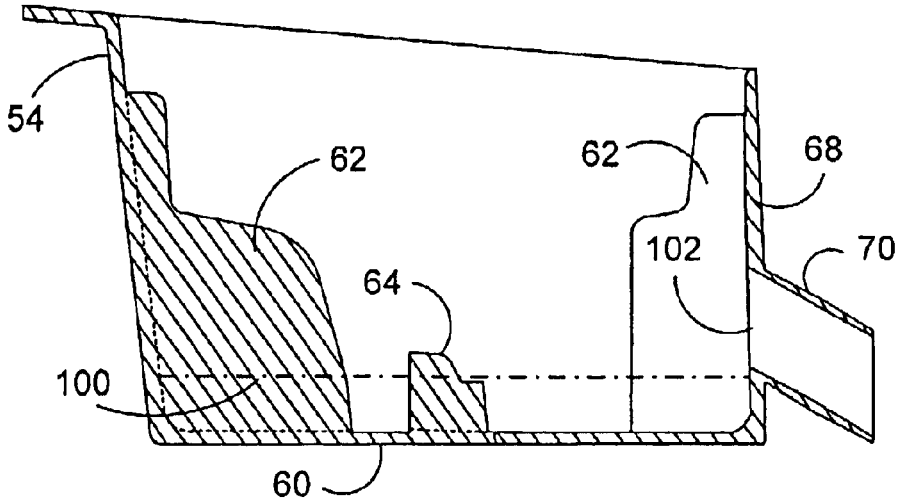
FIG. 5 illustrates a cross-sectional view of a reservoir having an overflow pipe according to another embodiment of the present invention.

As illustrated in FIG. 3, in accordance with the present invention, the overflow pipe 70 preferably extends through the bottom 60 of the reservoir 54. Overflow pipe 70 is preferably located along the center line of the reservoir 54, near the rib 64 that contacts the valve device 80. Overflow pipe 70 is also preferably located vertically through the bottom 60 of the reservoir 54. Alternatively, as illustrated in FIG. 4, the overflow pipe 70 need not be vertical through the bottom 60 of the reservoir 54 but instead could pass through at an angle. As another alternative, the overflow pipe 70 could pass through a side wall 68 of the reservoir 54 as illustrated in FIG. 5. Regardless of the location or orientation of the overflow pipe 70, the top opening 102 of overflow pipe 70 is situated above the normal operating level 100 of the moistening fluid in the reservoir 54. Preferably, the top opening 102 of the overflow pipe 70 is approximately 3–5 mm above the normal operating level 100 of the moistening fluid in the reservoir 54. In the event that the level of the moistening fluid within the reservoir 54 exceeds the normal operating level 100 and goes above the top opening 102 of the overflow pipe 70, i.e., an overflow condition, for any reason, the moistening fluid will enter the top opening 102 of the overflow pipe 70. For example, an improper seal of the valve device 80 with the bottle 52, or failure of the valve device 80, could cause the moistening fluid within the bottle 52 to be released into the reservoir 54 such that the level of moistening fluid exceeds the normal operating level 100. Additionally, repeated raising and lowering of the bottle 52, such as, for example, to determine if there is moistening fluid still present in the bottle 52, can cause the moistening fluid within the reservoir 54 to exceed the: normal operating level 100. Furthermore, if the mailing machine 10 is moved when the moistening fluid is at the normal operating level 100, it is possible that the mailing machine 10 can be tipped to a position in which the moistening fluid will exceed the normal operating level 100 on one side of the reservoir 54 and possibly leak over the side of the reservoir 54. Additionally, movement of the mailing machine 10 can cause movement of the moistening fluid within the reservoir 54, i.e., sloshing, thereby exceeding the normal operating level 100 at some point and possibly leaking over the sides of the reservoir 54.

Moistening fluid that has entered the top opening 102 of the overflow pipe 70 will drain from the reservoir 54 and through the opening 74 of sump 72. Preferably, an absorbent material 76 is provided in the sump 72. The absorbent material 76 could be, for example, a sponge, foam material or any other type of material that has absorbent properties. As the moistening fluid enters the sump 72, it will be absorbed by the absorbent material 76. Since the sump 72 is preferably open to the atmosphere, through opening 74, any moistening fluid that has drained into the sump 72 will evaporate after a period of time. The use of the absorbent material 76 provides several advantages. For example, any moistening fluid that has drained into the sump 72 will not slosh around should the mailing machine 10 be moved from one position to another. Additionally, the additional surface area of the absorbent material 76 will aid in evaporation of the moistening fluid.

Thus, according to the present invention, a system and method for managing overflow of moistening fluid from the reservoir 54 of a mailing machine 10 is provided. In the event the level of the moistening fluid rises above the normal operating level 100 to a level above the top opening 102 of the overflow pipe 70, the moistening fluid will flow through the overflow pipe 70 and into the sump 72. Accordingly, the moistening fluid will drain into the sump 72 before the reservoir 54 overflows or moistening fluid escapes from the reservoir 54 and onto any surrounding components or the supporting surface of the mailing machine 10. The overflow of moistening fluid from the reservoir 54 is safely contained within the mailing machine 10, thereby preventing the user from placing an unnecessary service call.

While the present invention has been described with respect to a mailing machine, it should be understood that the present invention is not so limited and can be utilized with any device that has a moistening/sealing system, such as, for example, an inserter and the like. Those skilled in the art will also recognize that various modifications can be made without departing from the spirit of the present invention. For example, the sump 72 need not be located directly beneath the reservoir 54, but instead can be located in some other area and the overflow pipe 70 coupled to the sump 72 with tubing. As another example, the sump 72 and reservoir 54 could be a single integral piece.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A moistening system comprising:

a reservoir to hold moistening fluid at a first level under normal operating conditions, the reservoir having a bottom surface and a plurality of side walls;

an overflow pipe having a first end inside the reservoir and a second end outside of the reservoir, the first end of the overflow pipe having a top opening situated at a second level, the second level being higher than the first level at which the moistening fluid is maintained under normal operating conditions and lower than a height of the side walls; and a sump associated with the reservoir, wherein if the level of moistening fluid rises above the second level, moistening fluid will flow into the top opening of the first end of the overflow pipe and pass out of the second end of the overflow pipe into the sump, thereby preventing the moistening fluid from flowing over any of the side walls.

2. The moistening system of claim 1, wherein the second level is approximately 3–5 mm above the first level.

3. The moistening system of claim 1, wherein the overflow pipe passes through the bottom surface of the reservoir.

4. The moistening system of claim 3, wherein the overflow pipe is substantially vertical through the bottom surface of the reservoir.

5. The moistening system of claim 3, wherein the overflow pipe is angled through the bottom surface of the reservoir.

6. The moistening system of claim 1, wherein the overflow pipe passes through one of the plurality of a side walls of the reservoir.

7. The moistening system of claim 1, wherein at least a portion of the sump is located beneath the second end of the overflow pipe.

8. The moistening system of claim 1, wherein the second end of the overflow pipe is coupled to the sump by a tube.

9. The moistening system of claim 1, further comprising:

an absorbent material located in the sump.

10. The moistening system of claim 9, wherein the absorbent material is foam.

11. The moistening system of claim 9, wherein the absorbent material is a sponge.

12. The moistening system of claim 1, further comprising:

a bottle adapted to couple with the reservoir, the bottle supplying the reservoir with moistening fluid.

13. A mailing machine comprising:

a reservoir having a bottom surface and a plurality of side walls to hold moistening fluid for sealing mail pieces being processed by the mailing machine, the moistening fluid being maintained at a first level under normal operating conditions;

an overflow pipe having a first end inside the reservoir and a second end outside of the reservoir, the first end of the overflow pipe having a top opening situated at a second level, the second level being higher than the first level at which the moistening fluid is maintained under normal operating conditions and lower than a height of the side walls; and a sump associated with the reservoir, wherein if the level of moistening fluid rises above the second level, moistening fluid will flow into the top opening of the first end of the overflow pipe and pass out of the second end of the overflow pipe into the sump, thereby preventing the moistening fluid from flowing over any of the side walls.

14. The mailing machine of claim 13, wherein the second level is approximately 3–5 mm above the first level.

15. The mailing machine of claim 13, wherein the overflow pipe passes through the bottom surface of the reservoir.

16. The mailing machine of claim 15, wherein the overflow pipe is substantially vertical through the bottom surface of the reservoir.

17. The moistening system of claim 15, wherein the overflow pipe is angled through the bottom surface of the reservoir.

18. The mailing machine of claim 13, wherein the overflow pipe passes through one of the plurality of side walls of the reservoir.

19. The mailing machine of claim 13, wherein the reservoir is secured to a base of the mailing machine and the sump is located beneath the reservoir such that at least a portion of the sump is located under the second end of the overflow pipe.

20. The mailing machine of claim 13, wherein the second end of the overflow pipe is coupled to the sump by a tube.

21. The mailing machine of claim 13, further comprising:

an absorbent material located in the sump.

22. The machine of claim 21, wherein the absorbent material is foam.

23. The machine of claim 21, wherein the absorbent material is a sponge.

24. The mailing machine of claim 13, further comprising:

a bottle adapted to couple with the reservoir, the bottle supplying the reservoir with moistening fluid.

* * * * *